US011703206B2

(12) United States Patent
Trice et al.

(10) Patent No.: US 11,703,206 B2
(45) Date of Patent: Jul. 18, 2023

(54) LIGHTING DEVICE WITH BASE SLEEVE

(71) Applicants: Cameron Trice, Oklahoma City, OK (US); Ryan Egbert, Oklahoma City, OK (US)

(72) Inventors: Cameron Trice, Oklahoma City, OK (US); Ryan Egbert, Oklahoma City, OK (US)

( * ) Notice: Subject to any disclaimer, the term of this patent is extended or adjusted under 35 U.S.C. 154(b) by 129 days.

(21) Appl. No.: 17/098,489

(22) Filed: Nov. 16, 2020

(65) Prior Publication Data

US 2022/0154910 A1 May 19, 2022

(51) Int. Cl.
*F21V 23/06* (2006.01)
*F21V 3/06* (2018.01)

(52) U.S. Cl.
CPC ..... *F21V 3/06* (2018.02); *F21V 23/06* (2013.01)

(58) Field of Classification Search
CPC ..... F21V 3/06; F21V 23/06
USPC ..... 362/317
See application file for complete search history.

(56) References Cited

U.S. PATENT DOCUMENTS 5,598,652 A * 2/1997 Nurre ..... G09F 13/00 362/412
8,777,445 B2 * 7/2014 Gourdie ..... F21V 35/00 362/190
2003/0134523 A1 * 7/2003 Hsu ..... F21S 4/10 439/56
2006/0146544 A1 * 7/2006 Leung ..... F21S 6/001 362/392
2007/0127249 A1 * 6/2007 Medley ..... H05B 31/50 362/392
2010/0046240 A1 * 2/2010 Marden ..... F21V 1/22 29/557
2016/0178156 A1 * 6/2016 Magras-Sinnen ..... F21V 1/22 403/364

* cited by examiner

*Primary Examiner* — Christopher M Raabe
(74) *Attorney, Agent, or Firm* — William Popejoy

(57) ABSTRACT

The present invention pertains to devices and applications for lighting device assemblies to provide a user versatile lighting options. More specifically, the invention pertains to a device or devices that utilize a removable sleeve mounted around a versatile lighting device base housing, and a housing with a 90 degree pivoting electrical cord attachment, which provide the user multiple design and mounting options. The sleeve may be comprised of one or more cutouts to allow access to different functionality. The sleeve may be cylindrical or any other geometric or abstract structure. In another embodiment of the invention, the lighting device assembly comprises a versatile base which may be placed on a flat surface, mounted to a wall, mounted to a ceiling, or hung by an electrical cord. An electrical cord attachment with a 90 degree pivot provides the user the ability to hang vertically.

13 Claims, 5 Drawing Sheets

LIGHTING DEVICE WITH BASE SLEEVE

BACKGROUND OF THE INVENTION

1. Field of the Invention

The present invention pertains to devices and applications for lighting device assemblies to provide a user versatile lighting options. More specifically, the invention pertains to a device or devices that utilize a removable sleeve mounted around a versatile lighting device base housing, and a base housing with a 90 degree pivoting electrical cord attachment, which provide the user multiple design and mounting options.

2. Description of the Related Art

Historically, lighting device bases vary in design, color, material, size, and structure. Once a lighting device is manufactured, the construction limits the device to serve a small number of purposes or areas. Post manufacture, lighting device versatility options include: the addition of different lamp shades, bulbs, and the placing/mounting of the device on either a horizontal or vertical surface based on its design.

U.S. patent application US20070230197 discloses lamps with multi-functional adaptabilities, including: standing, mounting, and hanging. The flexible mounting options are produced by modular components.

Japanese patent application JP2013504164 discloses an articulated lamp with various structural options for the lamp base or mounting mechanism, including: a weighted base, clamp, mount through a table, and a wall mount.

SUMMARY OF THE INVENTION

Embodiments described for the present invention use a sleeve adapted to be mounted around a lighting device base housing, where the sleeve may be removed and replaced by a user, providing the user versatile design options for a lighting device base housing. The sleeve may comprise one or more cutouts to allow access to different functionality. The sleeve may be cylindrical or any other geometric or abstract structure.

In another embodiment of the invention, the lighting device assembly comprises a versatile base which may be placed on a flat surface, mounted to a wall, mounted to a ceiling, or hung by an electrical cord. An electrical cord attachment with a 90 degree pivot provides the user the ability to hang vertically.

In other embodiments of the invention, the lighting device assembly may comprise: a sleeve open on both ends, a sleeve with a decorative exterior cloth, and a sleeve with interior ridges to provide support for the sleeve structure.

It should be appreciated that combinations of the foregoing concepts and additional concepts discussed in greater detail below are contemplated as being part of the inventive subject matter disclosed herein. In particular, all combinations of claimed subject matter appearing at the end of this disclosure, or elsewhere herein, are contemplated as being part of the inventive subject matter.

These and other systems, methods, objects, features, and advantages of the present invention will be apparent to those skilled in the art from the following detailed description of the preferred embodiment and the drawings.

BRIEF DESCRIPTION OF THE DRAWINGS

One or more embodiments are illustrated by way of example, and not by limitation, reference will now be made to the accompanying drawings, having the same numeral designations to represent like elements throughout and wherein.

Figure 1:
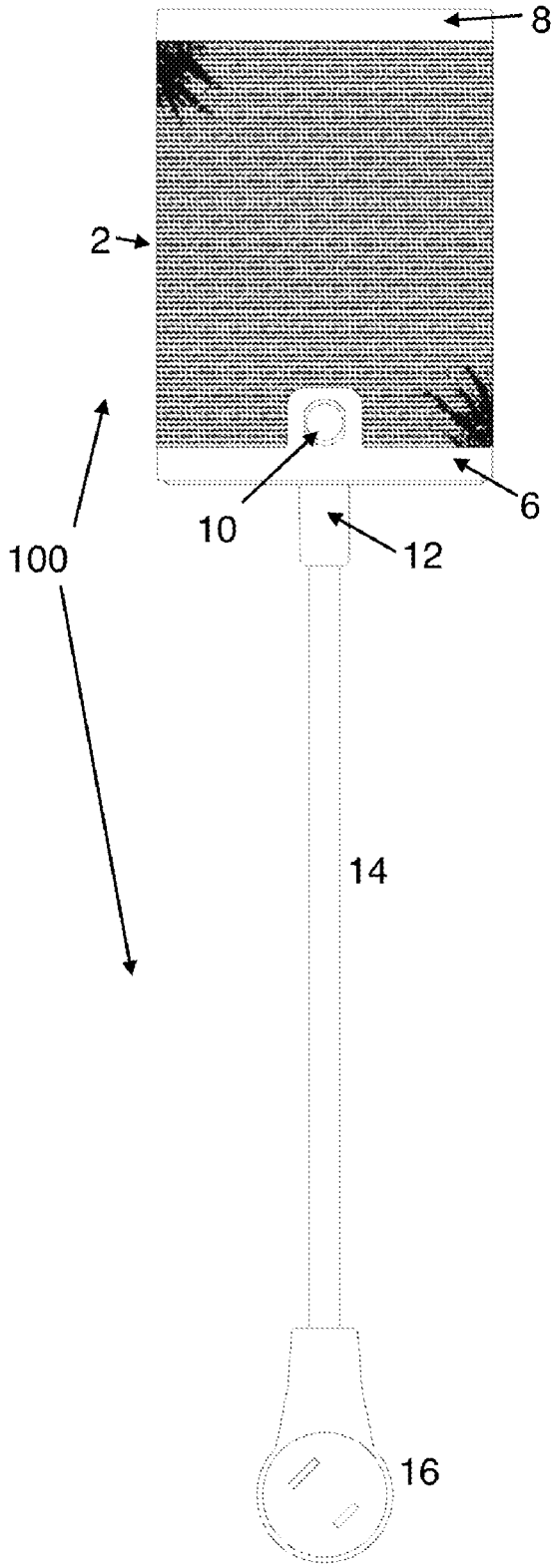
FIG. 1 shows a front elevational view of an embodiment of a lighting device assembly.
Figure 2:
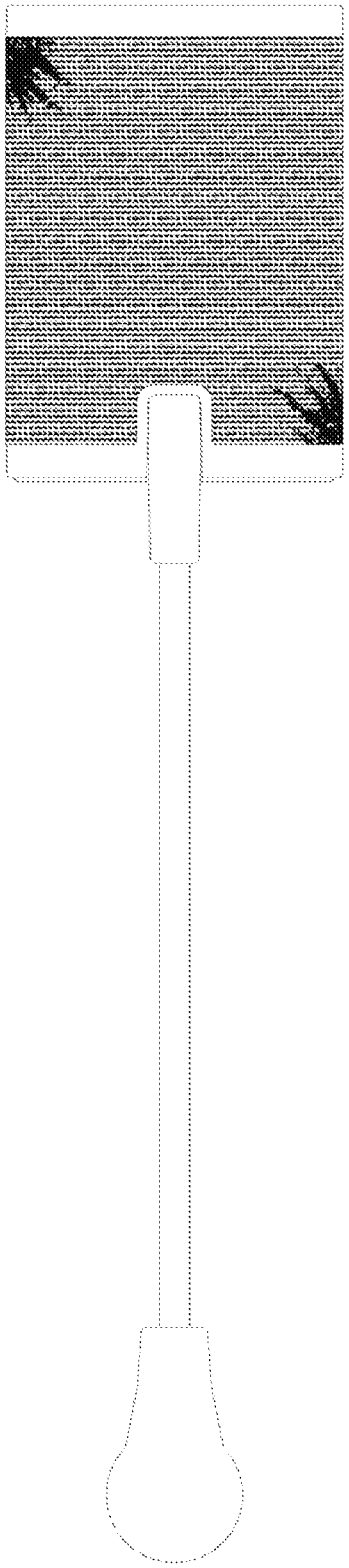
FIG. 2 shows a rear elevational view of an embodiment of a lighting device assembly.
Figure 3:
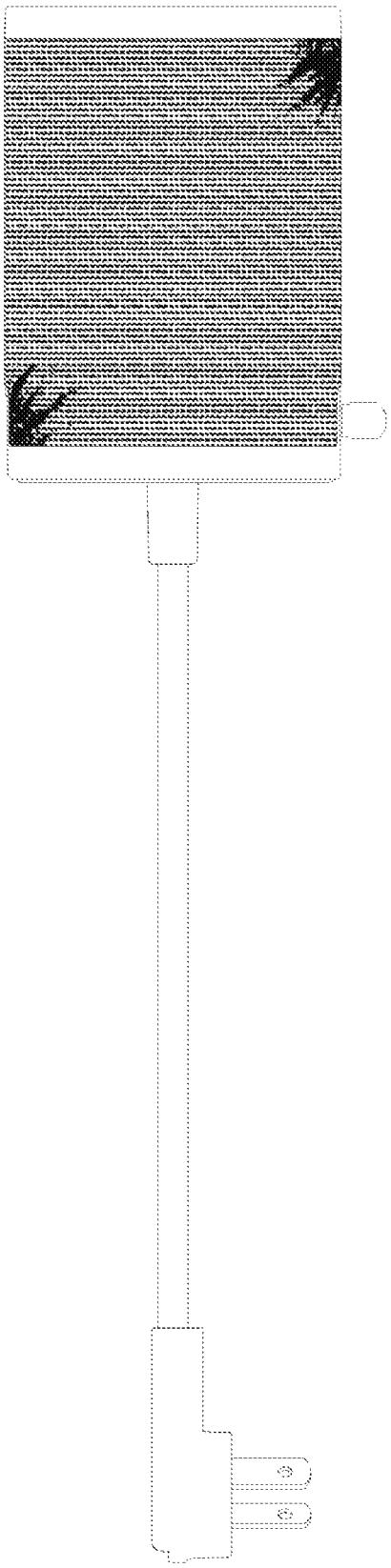
FIG. 3 shows a left side elevational view of an embodiment of a lighting device assembly.
Figure 4:
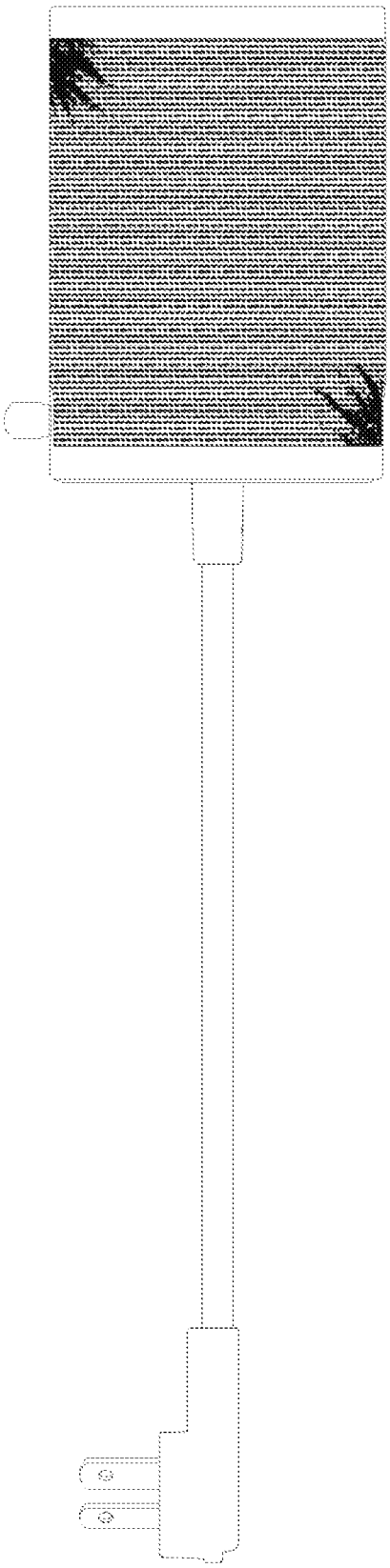
FIG. 4 shows a right side elevational view of an embodiment of a lighting device assembly.

While the invention has been described in connection with certain preferred embodiments, other embodiments would be understood by one of ordinary skill in the art and are encompassed herein.

ELEMENTS WITH CORRESPONDING REFERENCE NUMERALS

Lighting device assembly 100
Sleeve 2
Housing 4
Base 6
Top of the housing 8
Knob 10
Electrical cord attachment 12
Electrical cord 14
Plug 16
Light socket 18
Key holes 20
Base insert 22
Sleeve ridges 24
Sleeve exterior material 26
Cutout of the base 28
Cutout of the sleeve 30

DETAIL DESCRIPTION OF THE INVENTION

The claimed subject matter is described with reference to the drawings, wherein like reference numerals are used to refer to like elements throughout. In the following description, for purposes of explanation, numerous specific details are set forth in order to provide a thorough understanding of the subject innovation. It may be evident, however, that the claimed subject matter may be practiced without these specific details. In other instances, well-known structures and devices are shown in order to facilitate describing the subject innovation. Moreover, it is to be appreciated that the drawings may not be to scale.

FIG. 1 shows a front elevational view of an embodiment of a lighting device assembly 100. The lighting device assembly 100 may include a variety of components. The lighting device assembly 100 operates as a lamp which may be placed on a flat surface, mounted on a horizontal, vertical or angled surface, and may be hung by an electrical cord 14.

A sleeve 2 adapted to be mounted around a base housing 4 serves as a decorative cover for the base housing 4. The sleeve 2 may be removed and replaced by a user. The interchangeability of the sleeve 2 provides a user with current and future design options. Combined with the versatility of placement options within a home or office space, the lighting device assembly provides the user with numerous advantages over traditional lamps.

In FIG. 1, the sleeve 2 is open on both ends. However, in other embodiments, the sleeve 2 may be closed at one end. The top of the housing 8 may be attached and removed by a snap-on feature, screw-on feature, or may be attached by any means obvious to one having knowledge in the art. The removal of the top of the housing 8 allows the user to access, remove, and replace the sleeve 2. The sleeve 2 is held tightly in position against the base 6, which protrudes from the housing 4, by the attachment of the base 8.

FIG. 1 shows a front elevational view of a lighting device 100 with a cylindrical sleeve 2. However, the lighting device housing 4 and sleeve 2 may be cylindrical or any other geometric or abstract structure.

A cutout of the sleeve 30 may allow access to one or more knob 10, button, switch, timer, design feature, electrical outlet, usb outlet, attachment, and electrical cord 14. As in FIG. 1, two cutouts in the sleeve 30 allow access to a knob 10 which controls an on/off function of the device and access to an electrical cord attachment 12 which pivots 90 degrees.

The electrical cord attachment 12 may be attached to the center of the base 6 (not shown). The attachment of the electrical cord at the center of the base 6 allows the lighting device assembly 100 to hang vertically from the electrical cord 14 when the electrical cord attachment 12 is pivoted 90 degrees. The cutout of the base 28 allows the device to be placed, or mounted to a flat surface with an electrical cord attachment 12 at the center of the base 6.

The electrical cord 14 attaches to a plug 16 which may be inserted into a 110V outlet. Other embodiments of the current invention may use all plugs and power means obvious to one having skill in the art. The electrical cord 14 may be covered by a variety of materials that provide aesthetically pleasing design options.

Figure 5:
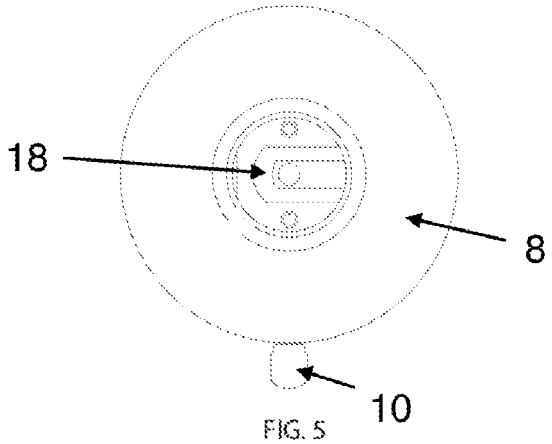
FIG. 5 shows a top view of an embodiment of a lighting device assembly.
Figure 6:
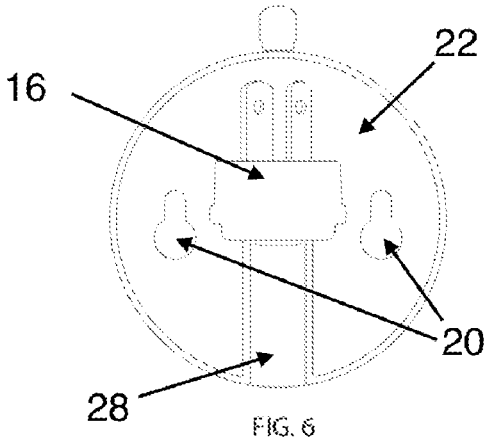
FIG. 6 shows a bottom view of an embodiment of a lighting device assembly.

FIG. 5 and FIG. 6 show a top and bottom view of an embodiment of a lighting device assembly 100. In FIG. 5, a light socket 18 is accessible through an opening in the top of the housing 8. In this embodiment, a light bulb (not shown) is inserted through the opening and screwed into the light socket 18. The knob 10 may be used to operate the on/off functionality of the lighting device assembly 100. The sleeve 2 is not visible from the top view of this embodiment.

In FIG. 6, two key holes 20 are visible on the bottom of the device. The key holes 20 allow the lighting device assembly 100 to be mounted on horizontal, vertical, and angled flat surfaces. Other components obvious to those skilled in the art may be used to mount the device. The two key holes 20 are accessible through two openings in the base insert 22. The base insert 22 may be constructed of various materials. In one embodiment, the base insert 22 may be constructed of rubber to provide stability once placed on a horizontal surface.

The cutout of the base 28 allows the electrical cord attachment 12 (not shown) to pivot a full 90 degrees. The 90 degree pivot provides the lighting device assembly 100 various placement options, including: the ability to be set, mounted, and hung vertically.

Figure 7:
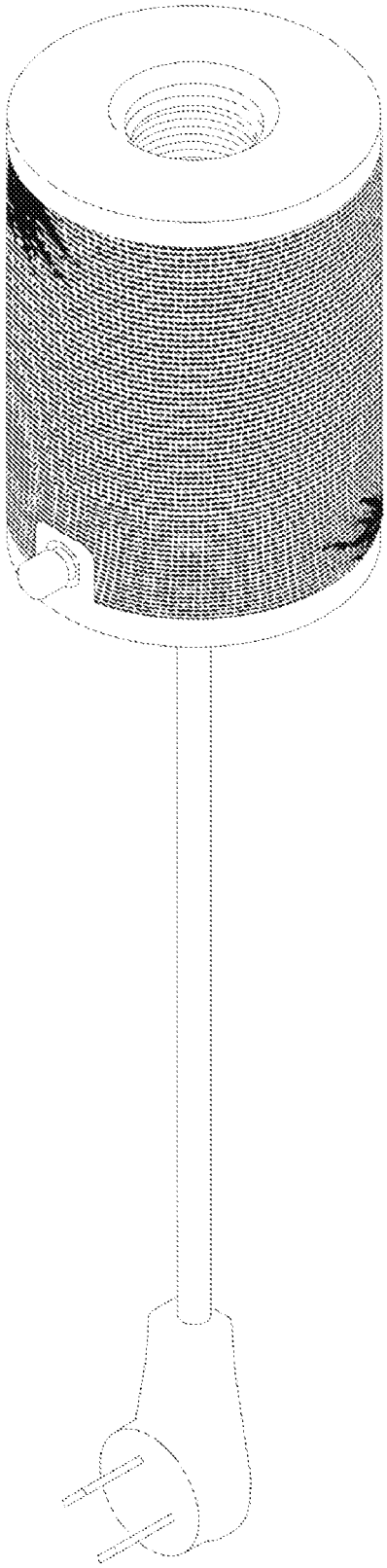
FIG. 7 shows a perspective view of an embodiment of a lighting device assembly.
Figure 8:
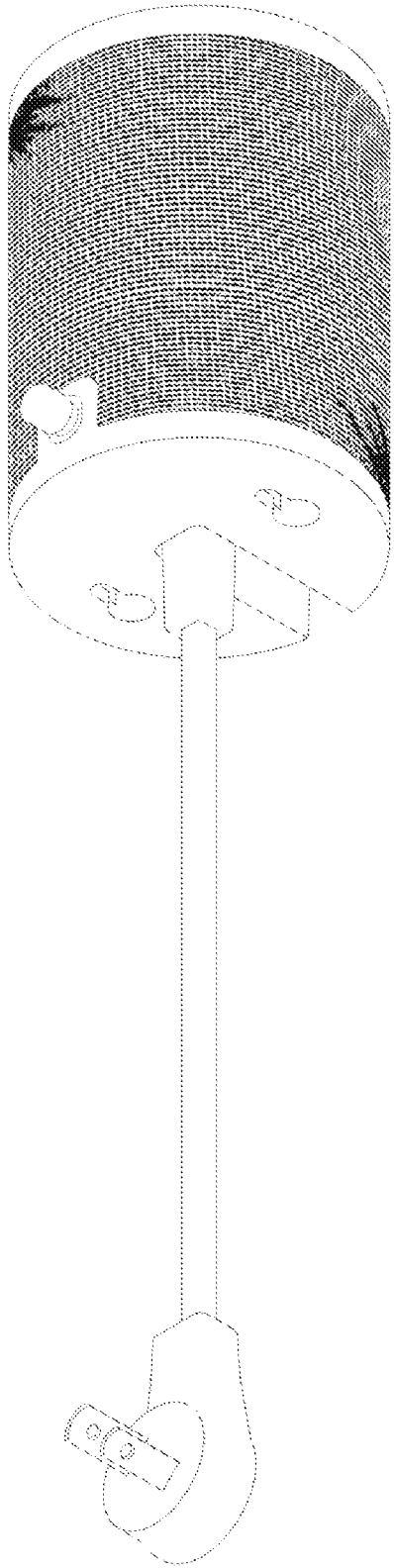
FIG. 8 shows another perspective view of an embodiment of a lighting device assembly.
Figure 9:
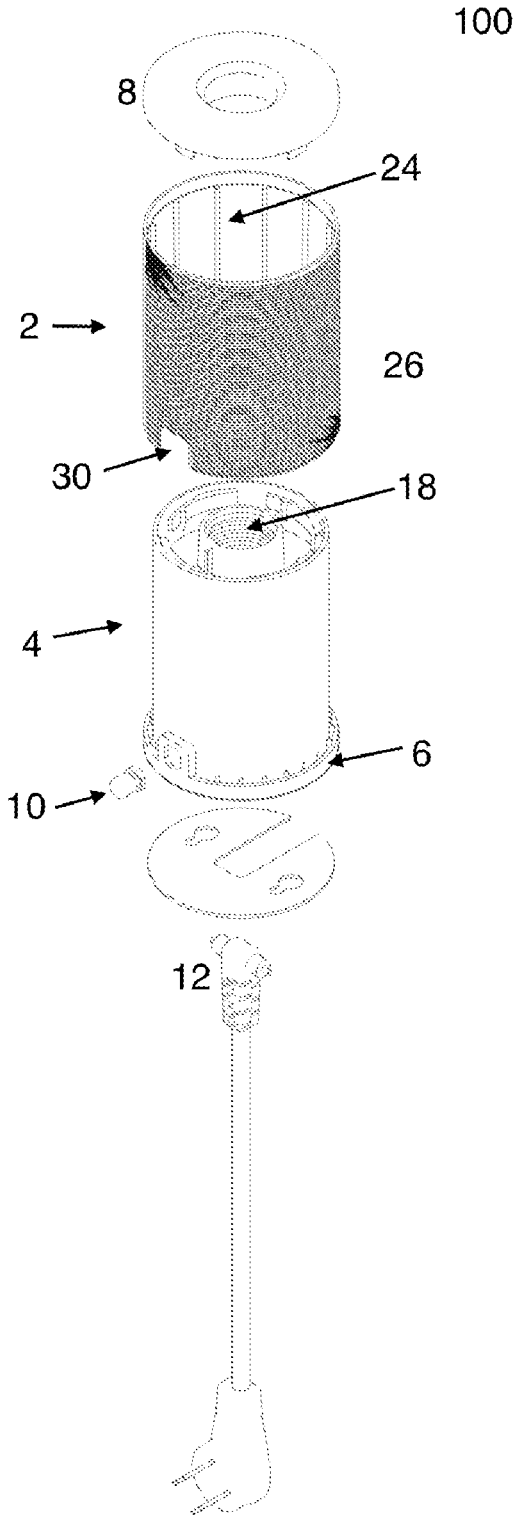
FIG. 9 shows an exploded view of an embodiment of a lighting device assembly.
Figure 10:
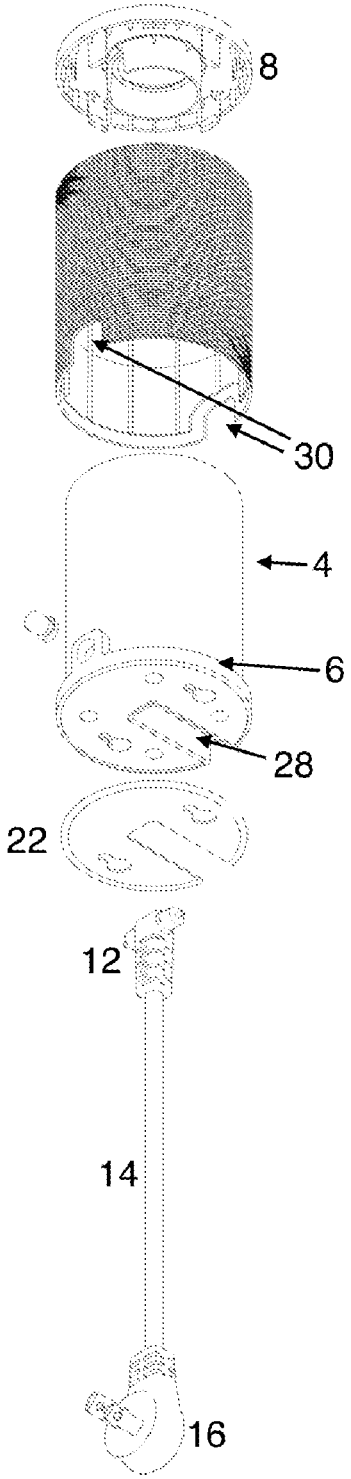
FIG. 10 shows another exploded view of an embodiment of a lighting device assembly.

FIG. 7 and FIG. 8 show perspective views of an embodiment of a lighting device assembly 100. The top of the housing 8 may be removed to allow access to the sleeve 2. Once the top of the base 8 is removed, the sleeve 2 may be taken off of the base 4 of the device. The sleeve may be comprised of interior sleeve ridges 24 which provide structural support for the lighting device assembly 100. The interior sleeve ridges 24 may vary in depth, size, construction, and placement. The sleeve 2 may comprise of one or more cutouts that allow access to the functionality of the device, and allow movement of the electrical cord attachment 12. The sleeve 2 may be comprised of various materials. All materials obvious to one having ordinary skill in the art may be used to construct the sleeve 2. In this embodiment, the inner portion of the sleeve 2 is comprised of plastic and the outer portion of the sleeve 2 is comprised of cloth.

Various materials used to construct the outer portion of the sleeve 2 may be used to provide the user with various design options.

In FIG. 7, the housing 4 of the device is visible with the removal of the sleeve 2. The housing 4 of the device is comprised of a light socket 18, where various light bulbs may be inserted into the device. After the removal of the top of the housing 8, the components which allow the top of the housing 8 to snap, screw, or attach by any means obvious to one skilled in the art may become visible.

The sleeve 2 is mounted around the housing 4 and may be secured by the top of the housing 8 and the base 6. The base 6 may protrude from the housing. The extension of the base 6 helps to secure the sleeve 2 against the top of the housing 8.

The housing 4 may comprise of various components that allow different functionality and design features. In FIG. 7, the housing 4 is comprised of a knob 10, which controls the on/off function of the device. The housing 4 may be comprised of one or more buttons, switches, knobs, timers, design features, electrical outlets, usb outlets, attachments, and electrical cords. Cutouts in the sleeve 30 may be necessary to access any and/or all of the different components. The base 6 may also be comprised of interior sleeve ridges 24 which provide the housing 4 and the sleeve 2 structural support.

In FIG. 8, the base insert 22 of the device is visible. The base insert 22 may be of various materials, including rubber, which may provide stability to the device once placed in a resting position. The housing 4 is engineered with a cutout of the base 28. The cutout 28 allows the electrical cord attachment 12 to pivot 90 degrees. The base insert 22 also has a cutout in a corresponding location to allow rotational movement of the electrical cord 14.

The electrical cord 14 may be comprised of any number of decorative exterior clothes or materials which provide an aesthetically pleasing design.

Although the present invention has been described in relation to particular embodiments thereof, many other variations and modifications will become apparent to those skilled in the art. It is preferred, therefore, that the present invention be limited not by the specific disclosure herein, but only by the appended claims. Alternate embodiments may be devised without departing from the spirit or scope of the invention. Further, the particular feature or structure may be combined in any suitable manner in one or more embodiments.

What is claimed is:

1. A lighting device assembly, comprising:

a lighting device housing;

a sleeve adapted to be mounted around the lighting device housing;

the sleeve configured to abut up to the base and configured to be held tightly into position by a top of the housing;

the sleeve is opaque, wherein the sleeve is not able to be seen through and the sleeve is not transparent;

the sleeve configured to be removed and replaced by a user;

the lighting device assembly configured to allow access to remove and to replace the sleeve upon removal of the top of the housing;

the sleeve configured to be separated from the lighting device housing, and the base;

the lighting device assembly and all components inside the lighting device housing configured to operate while the sleeve is removed from the lighting device assembly; and the sleeve is a decorative cover for the lighting device housing.

2. The lighting device assembly as claimed in claim 1 further comprising:

the sleeve comprises one or more cut outs to allow access for any of the following: electrical cord, button, switch, knob, timer, design feature, electrical outlet, usb outlet, and attachment.

3. The lighting device assembly as claimed in claim 1 further comprising:

the sleeve may be cylindrical or any other geometric or abstract structure.

4. The lighting device assembly as claimed in claim 1 further comprising:

the sleeve is open on both ends.

5. The lighting device assembly as claimed in claim 1 further comprising:

the sleeve comprises a decorative exterior cloth.

6. The lighting device assembly as claimed in claim 1 further comprising:

the sleeve comprises interior ridges to provide support for the sleeve structure.

7. A lighting device assembly, comprising:

a lighting device housing;

a sleeve adapted to be mounted around the lighting device housing;

the sleeve configured to abut up to the base and configured to be held tightly into position by a top of the housing;

the sleeve is opaque, wherein the sleeve is not able to be seen through and the sleeve is not transparent;

the sleeve configured to be removed and replaced by a user;

the lighting device assembly configured to allow access to remove and to replace the sleeve upon removal of the top of the housing;

the sleeve configured to be separated from the lighting device housing, and the base;

the lighting device assembly and all components inside the lighting device housing configured to operate while the sleeve is removed from the lighting device assembly;

the sleeve is a decorative cover for the lighting device housing;

a versatile base which may be placed on a flat surface, mounted to a wall, mounted to a ceiling, or hung by an electrical cord;

an electrical cord attachment to the center of the base with a 90 degree pivot;

a cut out within the base;

the cut out within the base allows the base to lay flat on a horizontal surface; and one or more keyhole mounting apertures.

8. The lighting device assembly as claimed in claim 7 further comprising:

the sleeve comprises one or more cut outs to allow access for any of the following: electrical cord, button, switch, knob, timer, design feature, electrical outlet, usb outlet, and attachment.

9. The lighting device assembly as claimed in claim 7 further comprising:

the sleeve may be cylindrical or any other geometric or abstract structure.

10. The lighting device assembly as claimed in claim 7 further comprising:

the sleeve is open on both ends.

11. The lighting device assembly as claimed in claim 7 further comprising:

the sleeve comprises a decorative exterior cloth.

12. The lighting device assembly as claimed in claim 7 further comprising:

the sleeve comprises interior ridges to provide support for the removable sleeve structure.

13. The lighting device assembly as claimed in claim 7 further comprising:

a rubberized insert at the base.

* * * * *